US006524959B1

(12) United States Patent
Lu et al.

(10) Patent No.: US 6,524,959 B1
(45) Date of Patent: Feb. 25, 2003

(54) CHEMICAL MECHANICAL POLISH (CMP) PLANARIZING METHOD EMPLOYING DERIVATIVE SIGNAL END-POINT MONITORING AND CONTROL

(75) Inventors: Chen-Fa Lu, Kaohsiung (TW); Chen-Peng Fan, Hsin Chu Hsien (TW); Jui-Ping Chuang, Taipei (TW); Tien-Chen Hu, Ping Tong (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 09/686,766

(22) Filed: Oct. 10, 2000

(51) Int. Cl.[7] ..... H01L 21/302

(52) U.S. Cl. ..... 438/690; 438/691; 438/692

(58) Field of Search ..... 438/690, 691, 438/692; 451/6, 41, 288; 156/345

(56) References Cited

U.S. PATENT DOCUMENTS

| | | | | |
|---|---|---|---|---|
| 5,392,124 A | | 2/1995 | Barbee et al. | 356/381 |
| 5,658,418 A | | 8/1997 | Coronel et al. | 156/345 |
| 6,010,538 A | * | 1/2000 | Sun et al. | 756/345 |
| 6,224,460 B1 | * | 5/2001 | Dunton et al. | 451/6 |

* cited by examiner

*Primary Examiner*—Benjamin L. Utech
*Assistant Examiner*—Kin-Chan Chen
(74) *Attorney, Agent, or Firm*—Tung & Associates

(57) ABSTRACT

Within a method for fabricating a microelectronic fabrication there is first provided a substrate having formed thereover a minimum of one microelectronic layer, where the minimum of one microelectronic layer is at least partially transparent to an incident radiation beam. There is then chemical mechanical polish (CMP) planarized the minimum of one microelectronic layer, while employing a chemical mechanical polish (CMP) planarizing method, to form from the minimum of one microelectronic layer a minimum of one chemical mechanical polish (CMP) planarized microelectronic layer. Within the method, a chemical mechanical polish (CMP) planarizing endpoint within the chemical mechanical polish (CMP) planarizing method with respect to the minimum of one chemical mechanical polish (CMP) planarized microelectronic layer is determined while employing the incident radiation beam incident upon the minimum of one microelectronic layer, in conjunction with a derivative of a property of a minimum of one reflected portion of the incident radiation beam reflected from the minimum of one microelectronic layer as the minimum of one microelectronic layer is chemical mechanical polish (CMP) planarized to form the minimum of one chemical mechanical polish (CMP) planarized microelectronic layer.

13 Claims, 1 Drawing Sheet

CHEMICAL MECHANICAL POLISH (CMP) PLANARIZING METHOD EMPLOYING DERIVATIVE SIGNAL END-POINT MONITORING AND CONTROL

BACKGROUND OF THE INVENTION

1. Field of the Invention

The present invention relates generally to chemical mechanical polish (CMP) planarizing methods for forming chemical mechanical polish (CMP) planarized microelectronic layers within microelectronic fabrications. More particularly, the present invention relates to end-point monitoring and control methods within the context of chemical mechanical polish (CMP) planarizing methods for forming chemical mechanical polish (CMP) planarized microelectronic layers within microelectronic fabrications.

2. Description of the Related Art

Microelectronic fabrications are formed from microelectronic substrates over which are formed patterned microelectronic conductor layers which are separated by microelectronic dielectric layers.

As microelectronic fabrication integration levels have increased and patterned microelectronic conductor layer dimensions have decreased, it has become increasingly common in the art of microelectronic fabrication to employ planarized microelectronic layers when fabricating microelectronic fabrications. Planarized microelectronic layers are desirable when fabricating microelectronic fabrications insofar as planarized microelectronic layers provide substrate layers upon which may more readily be formed, with enhanced reliability and enhanced functionality, additional microelectronic layers and additional microelectronic structures within microelectronic fabrications.

Of the methods which may be employed for forming planarized microelectronic layers within microelectronic fabrications, chemical mechanical polish (CMP) planarizing methods are particularly common and desirable insofar as chemical mechanical polish (CMP) planarizing methods may be readily adapted for forming various types of planarized microelectronic layers from various types of microelectronic materials within microelectronic fabrications.

While chemical mechanical polish (CMP) planarizing methods are thus clearly desirable in the art of microelectronic fabrication for forming planarized microelectronic layers from various types of microelectronic materials within microelectronic fabrications, chemical mechanical polish (CMP) planarizing methods are nonetheless not entirely without problems when employed for forming planarized microelectronic layers from various types of microelectronic materials within microelectronic fabrications. In that regard, it is recognized in the art of microelectronic fabrication that it is often difficult to accurately monitor and control a chemical mechanical polish (CMP) planarizing end-point when forming while employing a chemical mechanical polish (CMP) planarizing method a chemical mechanical polish (CMP) planarized microelectronic layer within a microelectronic fabrication.

It is thus desirable in the art of microelectronic fabrication to provide chemical mechanical polish (CMP) planarizing methods for forming, with enhanced chemical mechanical polish (CMP) planarizing end-point monitoring and control, chemical mechanical polish (CMP) planarized microelectronic layers within microelectronic fabrications.

It is towards the foregoing object that the present invention is directed.

Various end-point detection methods and apparatus have been disclosed in the art of microelectronic fabrication for forming microelectronic fabrication processed microelectronic layers with enhanced end-point monitoring and control within the art of microelectronic fabrication.

For example, Barbee et al., in U.S. Pat. No. 5,392,124, discloses a method and an apparatus for monitoring and controlling, both in-situ and in a real-time fashion, an end-point when completely etching with respect to a microelectronic substrate employed within a microelectronic fabrication a microelectronic layer formed upon the microelectronic substrate. To realize the foregoing object, the method and the apparatus employ, in general, a quantification of a secondary harmonic component within a reflected inspection light beam reflected from an interface of the microelectronic layer with the microelectronic substrate, as the microelectronic layer is being completely etched from upon the microelectronic substrate while being inspected with an incident inspection light beam having a primary harmonic component.

In addition, Coronel et al., in U.S. Pat. No. 5,658,418, discloses a method and an apparatus for monitoring and controlling, both in-situ and in a real-time fashion, an end-point when partially etching a microelectronic dielectric layer within a microelectronic fabrication. To realize the foregoing object, the method and the apparatus employ an optical detection method and an optical detection apparatus which in-turn preferably employ s minimum of two incident inspection light beams, each having with respect to the microelectronic dielectric layer being partially etched a wavelength of greater than 4*n*e, where n equals the index of refraction of a microelectronic dielectric material from which is formed the microelectronic dielectric layer and e equals a thickness of the microelectronic dielectric layer.

Finally, Sun et al., in U.S. Pat. No. 6,010,538, discloses a method and an apparatus for monitoring and controlling, both in-situ and in a real time fashion, an end-point when chemical mechanical polish (CMP) planarizing a microelectronic layer within a microelectronic fabrication while employing a chemical mechanical polish (CMP) planarizing apparatus. To realize the foregoing object, the method and apparatus employ a minimum of one sensor mechanically coupled to a carrier which carries within the chemical mechanical polish (CMP) planarizing apparatus a microelectronic substrate over which is formed the microelectronic layer which is chemical mechanical polish (CMP) planarized while employing the chemical mechanical polish (CMP) planarizing apparatus, and wherein an output signal from the minimum of one sensor is transmitted to a stationary receiver and controller by a radiative means, absent use of a physical transmission means such as an electrical or optical fiber cable, such as to control the chemical mechanical polish (CMP) planarizing apparatus.

Desirable in the art of microelectronic fabrication are additional chemical mechanical polish (CMP) planarizing methods for forming, with enhanced chemical mechanical polish (CMP) planarizing end-point monitoring and control, chemical mechanical polish (CMP) planarized microelectronic layers within microelectronic fabrications.

It is towards the foregoing object that the present invention is directed.

SUMMARY OF THE INVENTION

A first object of the present invention is to provide a chemical mechanical polish (CMP) planarizing method for forming from a microelectronic layer within a microelectronic fabrication a chemical mechanical polish (CMP) planarized microelectronic layer within the microelectronic fabrication.

A second object of the present invention is to provide a chemical mechanical polish (CMP) planarizing method in accord with the first object of the present invention, wherein there is provided an enhanced monitoring and control of a chemical mechanical polish (CMP) planarizing end-point within the chemical mechanical polish (CMP) planarizing method.

A third object of the present invention is to provide a chemical mechanical polish (CMP) planarizing method in accord with the first object and the second object of the present invention, which chemical mechanical polish (CMP) planarizing method is readily commercially implemented.

In accord within the objects of the present invention, there is provided by the present invention a method for fabricating a microelectronic fabrication. To practice the method of the present invention, there is first provided a substrate having formed thereover a minimum of one microelectronic layer, where the minimum of one microelectronic layer is at least partially transparent to an incident radiation beam. There is then chemical mechanical polish (CMP) planarized the minimum of one microelectronic layer, while employing a chemical mechanical polish (CMP) planarizing method, to form from the minimum of one microelectronic layer a minimum of one chemical mechanical polish (CMP) planarized microelectronic layer. Within the method of the present invention, a chemical mechanical polish (CMP) planarizing endpoint within the chemical mechanical polish (CMP) planarizing method with respect to the minimum of one chemical mechanical polish (CMP) planarized microelectronic layer is determined while employing the incident radiation beam incident upon the minimum of one microelectronic layer, in conjunction with a derivative of a property of a minimum of one reflected portion of the incident radiation beam reflected from the minimum of one microelectronic layer, as the minimum of one microelectronic layer is chemical mechanical polish (CMP) planarized to form the minimum of one chemical mechanical polish (CMP) planarized microelectronic layer.

The present invention provides a chemical mechanical polish (CMP) planarizing method for forming from a microelectronic layer within a microelectronic fabrication a chemical mechanical polish (CMP) planarized microelectronic layer within the microelectronic fabrication, wherein there is provided an enhanced monitoring and control of a chemical mechanical polish (CMP) planarizing end-point within the chemical mechanical polish (CMP) planarizing method. The present invention realizes the foregoing object by employing, when chemical mechanical polish (CMP) planarizing within a microelectronic fabrication a minimum of one microelectronic layer being at least partially transparent to an incident radiation beam to form from the minimum of one microelectronic layer within the microelectronic fabrication a minimum of one chemical mechanical polish (CMP) planarized microelectronic layer within the microelectronic fabrication, a chemical mechanical polish (CMP) planarizing end-point detection method within the chemical mechanical polish (CMP) planarizing method with respect to the minimum of one chemical mechanical polish (CMP) planarized microelectronic layer, wherein the chemical mechanical polish (CMP) end-point detection method employs the incident radiation beam incident upon the minimum of one microelectronic layer, in conjunction with a derivative of a property of a minimum of one reflected portion of the incident radiation beam reflected from the minimum of one microelectronic layer as the minimum of one microelectronic layer is chemical mechanical polish (CMP) planarized to form the minimum of one chemical mechanical polish (CMP) planarized microelectronic layer.

The method of the present invention is readily commercially implemented. The present invention employs methods and materials as are otherwise generally conventional in the art of microelectronic fabrication, but employed within the context of specific process limitations and materials selections to provide the present invention. Since it is thus a series of process limitation considerations and materials selection considerations which provides at least in part the present invention, rather than the existence of methods and materials which provides the present invention, the method of the present invention is readily commercially implemented.

BRIEF DESCRIPTION OF THE DRAWINGS

The objects, features and advantages of the present invention are understood within the context of the Description of the Preferred Embodiment, as set forth below. The Description of the Preferred Embodiment is understood within the context of the accompanying drawings, which form a material part of this disclosure, wherein.

DESCRIPTION OF THE PREFERRED EMBODIMENT

The present invention provides a chemical mechanical polish (CMP) planarizing method for forming from a microelectronic layer within a microelectronic fabrication a chemical mechanical polish (CMP) planarized microelectronic layer within the microelectronic fabrication, wherein there is provided an enhanced monitoring and control of a chemical mechanical polish (CMP) planarizing end-point within the chemical mechanical polish (CMP) planarizing method. The present invention realizes the foregoing object by employing, when chemical mechanical polish (CMP) planarizing within a microelectronic fabrication a minimum of one microelectronic layer being at least partially transparent to an incident radiation beam to form from the minimum of one microelectronic layer within the microelectronic fabrication a minimum of one chemical mechanical polish (CMP) planarized microelectronic layer within the microelectronic fabrication, a chemical mechanical polish (CMP) planarizing end-point detection method within the chemical mechanical polish (CMP) planarizing method with respect to the minimum of one chemical mechanical polish (CMP) planarized microelectronic layer, wherein the chemical mechanical polish (CMP) end-point detection method employs the incident radiation beam incident upon the minimum of one microelectronic layer, in conjunction with a derivative of a property of a minimum of one reflected portion of the incident radiation beam reflected from the minimum of one microelectronic layer as the minimum of one microelectronic layer is chemical mechanical polish (CMP) planarized to form the minimum of one chemical mechanical polish (CMP) planarized microelectronic layer.

Although the preferred embodiment of the present invention illustrates the present invention within the context of enhanced monitoring and control of a chemical mechanical polish (CMP) planarizing end-point when chemical mechanical polish (CMP) planarizing a microelectronic layer formed of a microelectronic dielectric material within a microelectronic fabrication, as is understood by a person skilled in the art, the present invention may in general be employed for providing enhanced monitoring and control of a chemical mechanical polish (CMP) planarizing end-point when chemical mechanical polish (CMP) planarizing within microelectronic fabrications of various varieties microelectronic layers formed of microelectronic materials including but not limited to microelectronic conductor materials, microelectronic semiconductor materials and microelectronic dielectric materials, provided that the microelectronic conductor materials, microelectronic semiconductor materials and microelectronic dielectric material have sufficient radiation transparency as further specified within the context of the preferred embodiment of the present invention.

Figure 1:
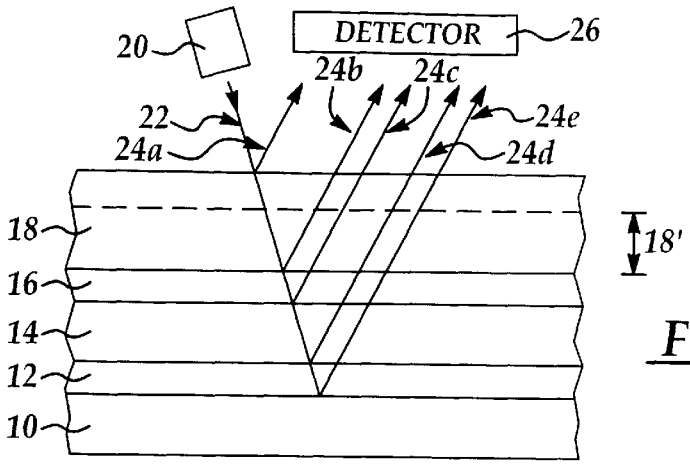
FIG. 1 shows a schematic cross-sectional diagram of a microelectronic fabrication which may be fabricated while employing the method of the present invention.

Referring now to FIG. 1, there is shown a schematic cross-sectional diagram of a microelectronic fabrication which may be fabricated in accord with the present invention, and further in accord with the preferred embodiment of the present invention.

Shown in FIG. 1 in a first instance is a substrate 10, having formed thereupon a series of four blanket microelectronic layers comprising: (1) a blanket first dielectric layer 12 formed upon the substrate 10; (2) a blanket second dielectric layer 14 formed upon the blanket first dielectric layer 12; (3) a blanket third dielectric layer 16 formed upon the blanket second dielectric layer 14; and (4) a blanket fourth dielectric layer 18 formed upon the blanket third dielectric layer 16.

Within the preferred embodiment of the present invention with respect to the substrate 10, the substrate 10 may be a substrate employed within a microelectronic fabrication selected from the group including but not limited to integrated circuit microelectronic fabrications, ceramic substrate microelectronic fabrications, solar cell optoelectronic microelectronic fabrications, sensor image array optoelectronic microelectronic fabrications and display image array optoelectronic microelectronic fabrications. More typically and preferably, the substrate 10 comprises a semiconductor substrate employed within a semiconductor integrated circuit microelectronic fabrication.

Although not specifically illustrated within the schematic cross-sectional diagram of FIG. 1, the substrate 10, typically and preferably, but not exclusively, when the substrate 10 consists of or comprises a semiconductor substrate employed within a semiconductor integrated circuit microelectronic fabrication, typically and preferably has formed therein and/or thereupon microelectronic devices as are conventional within a microelectronic fabrication within which is employed the substrate 10. Such microelectronic devices may include, but are not limited to resistors, transistors, diodes and capacitors.

Within the preferred embodiment of the present invention with respect to the series of four blanket microelectronic layers comprising the blanket first dielectric layer 12, the blanket second dielectric layer 14, the blanket third dielectric layer 16 and the blanket fourth dielectric layer 18, although the series of four blanket microelectronic layers comprising the blanket first dielectric layer 12, the blanket second dielectric layer 14, the blanket third dielectric layer 16 and the blanket fourth dielectric layer 18 may be formed from any of several dielectric materials as are conventional in the art of microelectronic fabrication, including but not limited to conventional silicon oxide dielectric materials, silicon nitride dielectric materials and silicon oxynitride dielectric materials having a dielectric constant of from about 3.0 to about 6.0, as well as lesser conventional lower dielectric constant dielectric materials having a dielectric constant off from about 2.0 to about 3.0, such as but not limited to spin-on-glass (SOG) dielectric materials and spin-on-polymer (SOP) dielectric materials, from a practical perspective, the present invention provides particular value under circumstances where various of the blanket layers within the series of four blanket microelectronic layers comprising the blanket first dielectric layer 12, the blanket second dielectric layer 14, the blanket third dielectric layer 16 and the blanket fourth dielectric layer 18 have divergent indices of refraction and/or some variability in transmissivity and absorptivity of an incident radiation beam 22 whose characteristics are discussed further below. Thus, from a practical perspective, various of the blanket layers within the series of four blanket microelectronic layers comprising the blanket first dielectric layer 12, the blanket second dielectric layer 14, the blanket third dielectric layer 16 and the blanket fourth dielectric layer 18 are typically and preferably formed of various dielectric materials.

More typically and preferably, within the preferred embodiment of the present invention, both the blanket fist dielectric layer 12 and the blanket third dielectric layer 16 are formed of a silicon nitride dielectric material deposited employing methods as are conventional in the art of microelectronic fabrication, where the blanket first dielectric layer 12 is formed to a thickness of from about 400 to about 700 angstroms and the blanket third dielectric layer 16 is formed to a thickness of from about 300 to about 500 angstroms. Similarly, more typically and preferably, within the preferred embodiment of the present invention, the blanket second dielectric layer 14 and the blanket fourth dielectric layer 18 are each formed of a silicon oxide dielectric material, with the blanket second dielectric layer 14 typically and preferably being formed to a thickness of from about 3000 to about 4000 angstroms and the blanket fourth dielectric layer 18 typically and preferably being formed to a thickness of from about 12000 to about 14000 angstroms.

Finally, as suggested above, within the preferred embodiment of the present invention, each blanket microelectronic layer within the series of four blanket microelectronic layers comprising the blanket first dielectric layer 12, the blanket second dielectric layer 14, the blanket third dielectric layer 16 and the blanket fourth dielectric layer 18 is at least partially transparent to the incident radiation beam 22 whose characteristics are discussed more fully below. Typically and preferably, each blanket layer within the series of four blanket layers comprising the blanket first dielectric layer 12, the blanket second dielectric layer 14, the blanket third dielectric layer 16 and the blanket fourth dielectric layer 18 has a transmissivity with respect to the radiation beam 22 of at least about 30 percent, more preferably from about 50 to about 99 percent and most preferably from about 90 to about 98 percent.

Shown also within the schematic cross-sectional diagram of FIG. 1 is a radiation beam source 20 from which issues the incident radiation beam 22 which is incident upon the blanket fourth dielectric layer 18, but due to transparency of the blanket fourth dielectric layer 18, the blanket third dielectric layer 16, the blanket second dielectric layer 14 and the blanket second dielectric layer 12 with respect to the radiation beam 22, the radiation beam also passes at least in part through the blanket fourth dielectric layer 18, the blanket third dielectric layer 16, the blanket second dielectric layer 14 and the blanket first dielectric layer 12 before being completely reflected by the substrate 10.

Within the preferred embodiment of the present invention, the radiation beam source 20 may be selected from the group of radiation beam sources including but not limited to optical radiation beam sources and acoustic radiation beam sources which provide radiation beams including but not limited to optical radiation beams (of various wavelengths, including but not limited to infrared, visible and ultraviolet wavelengths) and acoustic radiation beams. Most typically and preferably, the radiation beam source 20 is a laser radiation beam source which provides a coherent laser incident radiation beam 22.

Finally, there is shown within the schematic cross-sectional diagram of FIG. 1 a series of reflected radiation beams 24*a*, 24*b*, 24*c*, 24*d* and 24*e* which are captured by a detector 26. Within the preferred embodiment of the present invention, the series of reflected radiation beams 24*a*, 24*b*, 24*c*, 24*d* and 24*e* is, as is illustrated within the schematic cross-sectional diagram of FIG. 1, reflected from various of the surfaces and interfaces of the series of four blanket microelectronic layers comprising the blanket first dielectric layer 12, the blanket second dielectric layer 14, the blanket third dielectric layer 16 and the blanket fourth dielectric layer 18 with respect to each other and with respect to the substrate 10, as is otherwise generally conventional in the art of optical diffraction and interference within the context of microelectronic fabrication. Similarly, as is further understood by a person skilled in the art, the detector 26 is a detector as is appropriate for detecting the reflected radiation beams 24*a*, 24*b*, 24*c*, 24*d* and 24*e*. Under circumstances where the incident radiation beam 22 is an optical radiation beam, such as but not limited to a laser radiation beam, the detector is typically and preferably a photodiode array which is capable of quantifying a property of at least one of the reflected radiation beams 24*a*, 24*b*, 24*c*, 24*d* and 24*e*, such property typically and preferably being an optical intensity.

As is understood by a person skilled in the art, although the preferred embodiment of the present invention illustrates the present invention with respect to the incident radiation beam 22 at a non-orthogonal incident angle with respect to the substrate 10 and the series of reflected radiation beams 24*a*, 24*b*, 24*c*, 24*d* and 24*e* at a corresponding non-orthogonal reflection angle with respect to the substrate 10, the present invention is operative when the incident radiation beam is either substantially orthogonal to the substrate 10 (i.e., within about +/−5 degrees from orthogonal) or substantially non-orthogonal to the substrate 10 (i.e., from about 5 to about 80 degrees from orthogonal).

Similarly, as is also understood by a person skilled in the art, although the preferred embodiment of the present invention illustrates the present invention within the context of the incident radiation beam 22 as impinging directly upon the blanket fourth dielectric layer 18 and a remaining portion of the incident radiation beam 22 as being reflected from the substrate 10, under circumstances where the substrate 10 is transparent to the radiation beam 22, such as when the radiation beam 22 is an acoustic radiation beam, the radiation beam 22 may alternatively impinge directly upon the substrate 10 rather than the blanket fourth dielectric layer 18.

Yet similarly, as is also understood by a person skilled in the art, and as is illustrated within the schematic cross-sectional diagram of FIG. 1, it is desirable within the present invention and the preferred embodiment of the present invention to chemical mechanical polish (CMP) planarize the blanket fourth dielectric layer 18 to form therefrom a chemical mechanical polish (CMP) planarized blanket fourth dielectric layer 18' as illustrated within the context of the phantom lines as illustrated within the schematic cross-sectional diagram of FIG. 1, but in so doing, within the context of the present invention, to do so with enhanced chemical mechanical polish (CMP) planarizing endpoint monitoring and control.

To realize the foregoing object within the context of the present invention, there is first employed a chemical mechanical polish (CMP) planarizing method as is otherwise conventional in the art of microelectronic fabrication, which within the context of the preferred embodiment of the present invention where the blanket fourth dielectric layer 18 is formed of a silicon oxide dielectric material will typically and preferably employ a colloidal silica slurry composition.

Significant within the context of the present invention is that the detector 26 as illustrated within the schematic cross-sectional diagram of FIG. 1 employs when quantifying a measured property of the reflected radiation beams 24*a*, 24*b*, 24*c*, 24*d* and 24*e* a derivative of the measured property of the reflected radiation beams 24*a*, 24*b*, 24*c*, 24*d* and 24*e*. Typically and preferably, the derivative is determined over a period of time of at least about 0 seconds, more typically and preferably from about 6 to about 24 seconds. By employing such a derivative within the context of the present invention, there is avoided within the context of the present invention a very sharp chemical mechanical polish (CMP) planarizing endpoint when chemical mechanical polish (CMP) planarizing the blanket fourth dielectric layer 18 when forming the chemical mechanical polish (CMP) planarized blanket fourth dielectric layer 18' therefrom, which very sharp chemical mechanical polish (CMP) planarizing endpoint it is comparatively easy to overshoot and thus incur compromised process control when forming from the blanket fourth dielectric layer 18 the chemical mechanical polish (CMP) planarized blanket fourth dielectric layer 18'.

Figure 2:
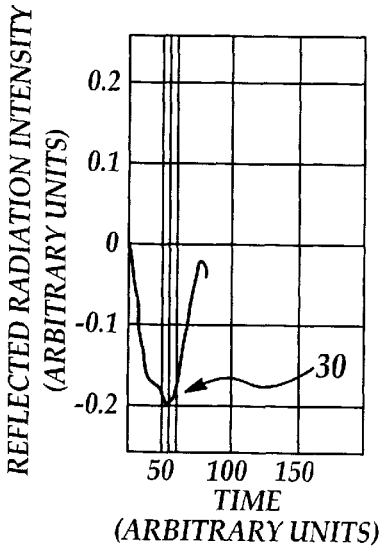
FIG. 2 and FIG. 3 show a pair of graphs illustrating either: (1) Reflected Radiation Intensity versus Time; or (2) Reflected Radiation Intensity Derivative versus Time, for a microelectronic fabrication fabricated in accord with an example of the present invention.
Figure 3:
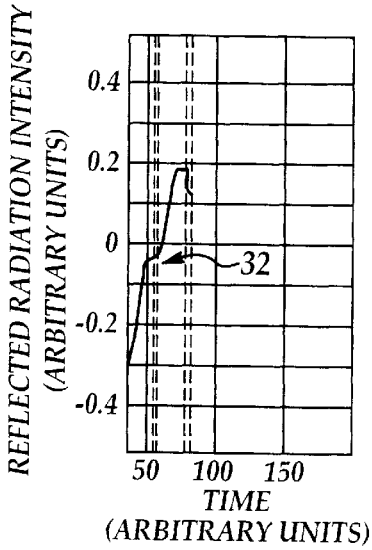

Referring now to FIG. 2 and FIG. 3, there is shown a pair of plots of Reflected Radiation Intensity versus Time and Reflected Radiation Intensity Derivative versus Time with respect to an example of the present invention which better illustrates the value of the method of the present invention.

With respect to the example of the present invention, there was prepared a series of microelectronic fabrications analogous to the microelectronic fabrication whose schematic cross-sectional diagram is illustrated in FIG. 1. The series of microelectronic fabrications comprised a series of semiconductor substrates having formed thereupon a series of blanket first silicon nitride layers of thickness about 600 angstroms, in turn having formed thereupon a series of blanket silicon oxide layers of thickness about 3800 angstroms, in turn having formed thereupon a series of blanket second silicon nitride layers of thickness about 400 angstroms, in turn having formed thereupon a series of blanket boro-phospho-silicate glass (BPSG) layers of thickness about 13000 angstroms. Each of the above four series of dielectric layers was formed employing chemical vapor deposition (CVD) methods as are otherwise conventional in the art of microelectronic fabrication.

The series of blanket boro-phospho-silicate glass (BPSG) dielectric layers was then chemical mechanical polish (CMP) planarized while employing a silica slurry and while employing an otherwise conventional chemical mechanical polish (CMP) planarizing apparatus employing chemical mechanical polish (CMP) planarizing parameters which included: (1) a head rotation speed of about 35 revolutions per minute; (2) a platen counter-rotation speed of about 35 revolutions per minute; (3) a membrane pressure of about 3.5 pounds per square inch; and (4) a slurry feed rate of about 150 cubic centimeters per minute (com). Target chemical mechanical polish (CMP) planarizing thickness of the series of chemical mechanical polish (CMP) planarized blanket boro-phospho-silicate glass (BPSG) dielectric layers were about 9700 angstroms each.

The chemical mechanical polish (CMP) planarizing method was monitored and controlled while employing a helium neon laser 6700 angstrom incident radiation beam of diameter about 1 millimeters incident upon the blanket boro-phospho-silicate glass (BPSG) dielectric layer at an angle of incidence of about 16 degrees, wherein reflected portions of the helium neon laser incident radiation beam were collected and classified while employing a photo diode array of appropriate spectral sensitivity.

Shown in FIG. 2 is a plot of Reflected Radiation Intensity versus Time as observed when chemical mechanical polish (CMP) planarizing a blanket boro-phospho-silicate glass (BPSG) dielectric layer in accord with the example of the present invention. As is illustrated within the plot of FIG. 2, there is a generally sharp inversion point 30, at which generally sharp inversion point 30 a chemical mechanical polish (CMP) planarizing endpoint is reached.

In accord with the present invention and the preferred embodiment of the present invention, there is also illustrated within FIG. 3 a plot of Reflected Radiation Intensity Derivative versus Time, which in an alternative of the generally sharp inversion point 30 as illustrated within the plot of FIG. 2 instead has a more gentle inflection point 32. By virtue of the existence of the more gentle inflection point 32 within the plot of FIG. 3, in comparison with the generally sharp inversion point 30 as illustrated within the plot of FIG. 2, the chemical mechanical polish (CMP) planarizing method in accord with the preferred embodiment of the present invention is more readily monitored and controlled, thus providing a more accurate endpoint when forming from a blanket boro-phospho-silicate glass (BPSG) dielectric layer in accord with the examples of the present invention a chemical mechanical polish (CMP) planarized blanket boro-phospho-silicate glass (BPSG) dielectric layer in accord with the examples of the present invention.

Figure 4:
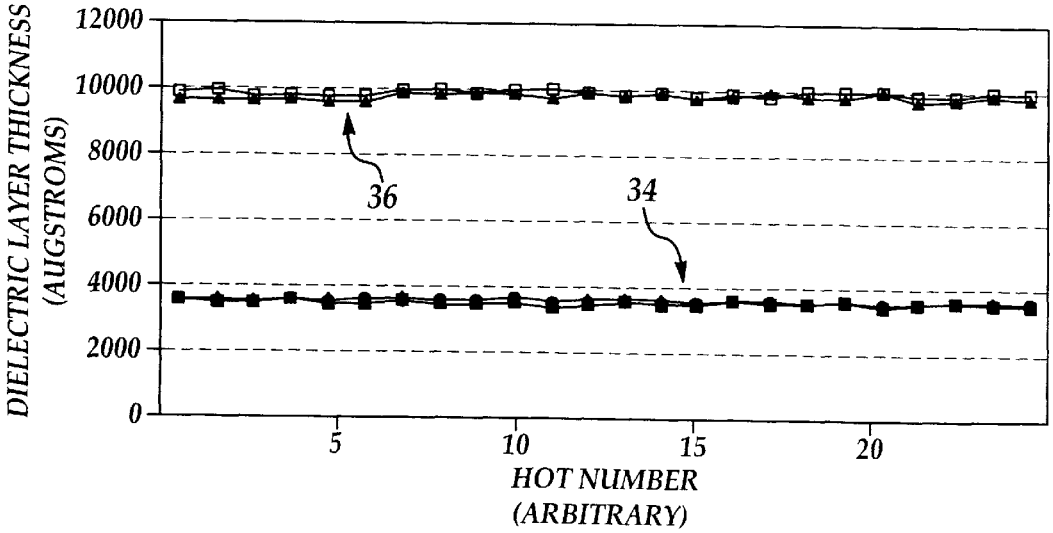
FIG. 4 shows a graph of Dielectric Layer Thickness versus Lot Number for a series of microelectronic fabrications fabricated in accord with the example of the present invention.

Referring now to FIG. 4, there is shown a graph of Dielectric Layer Thickness versus Lot Number for the series of blanket silicon oxide dielectric layers and the series of chemical mechanical polish (CMP) planarized blanket boro-phospho-silicate glass (BPSG) dielectric layers formed within the series of microelectronic fabrications in accord with the examples of the present invention.

Within the graph of FIG. 4, the curve which corresponds with reference numeral 34 corresponds with thicknesses, as measured employing a scanning electron microscopy (SEM) method, of the series of blanket silicon oxide dielectric layers formed within the series of microelectronic fabrications in accord with the examples of the present invention. Similarly, within the graph of FIG. 4, the curve which corresponds with reference numeral 36 corresponds with thicknesses, as measured employing the scanning electron microscopy method, of a series of chemical mechanical polish (CMP) planarized blanket boro-phospho-silicate glass (BPSG) dielectric layers in accord with the examples of the present invention.

As is seen from review of the data within the graph of FIG. 4, and in particular with respect to the thicknesses of the series of chemical mechanical polish (CMP) planarized blanket boro-phospho-silicate glass (BPSG) dielectric layers, the series of chemical mechanical polish (CMP) planarized blanket boro-phospho-silicate glass (BPSG) dielectric layers is formed with enhanced thickness uniformity due to enhanced monitoring and control of a chemical mechanical polish (CMP) planarizing end-point.

As is understood by a person skilled in the art, the preferred embodiment and examples of the present invention are illustrative of the present invention rather than limiting of the present invention. Revisions and modifications may be made to methods, materials, structures and dimensions through which is provided a microelectronic fabrication in accord with the preferred embodiment and examples of the present invention, while still providing a microelectronic fabrication in accord with the present invention, further in accord with the accompanying claims.

What is claimed is:

1. A method for fabricating a microelectronic fabrication comprising:

providing a substrate having formed thereover a minimum of one microelectronic layer, the minimum of one microelectronic layer being at least partially transparent to an incident radiation beam;

positioning the incident radiation beam to be incident first upon the minimum of one microelectronic layer and then upon the substrate;

chemical mechanical polish planarizing the minimum of one microelectronic layer, while employing a chemical mechanical polish planarizing method, to form from the minimum of one microelectronic layer a minimum of one chemical mechanical polish planarized microelectronic layer; and determining a chemical mechanical polish planarizing endpoint within the chemical mechanical polish planarizing method with respect to the minimum of one chemical mechanical polish planarized microelectronic layer as an inflection point within a derivative of a reflected radiation intensity of a minimum of one reflected portion of the incident radiation beam reflected from the minimum of one microelectronic layer as the minimum of one microelectronic layer is chemical mechanical polish planarized to form the minimum of one chemical mechanical polish planarized microelectronic layer.

2. The method of claim 1 wherein the substrate is employed within a microelectronic fabrication selected from the group consisting of integrated circuit microelectronic fabrications, ceramic substrate microelectronic fabrications, solar cell optoelectronic microelectronic fabrications, sensor image array optoelectronic microelectronic fabrications and display image array optoelectronic microelectronic fabrications.

3. The method of claim 1 wherein the microelectronic layer is formed from a microelectronic material selected from the group consisting of microelectronic conductor materials, microelectronic semiconductor materials and microelectronic dielectric materials.

4. The method of claim 1 wherein the radiation beam is selected from the group consisting of optical radiation beams and acoustic radiation beams.

5. The method of claim 1 wherein the radiation beam impinges directly upon a surface of the minimum of one microelectronic layer.

6. The method of claim 1 wherein the radiation beam is incident substantially orthogonally to the substrate.

7. The method of claim 1 wherein the radiation beam is incident substantially non-orthogonally to the substrate.

8. A method for fabricating a semiconductor integrated circuit microelectronic fabrication comprising:

providing a semiconductor substrate having formed thereover a minimum of one micrelectronic layer, the minimum of one microelectronic layer being at least partially transparent to an incident radiation beam;

positioning the incident radiation beam to be incident first upon the minimum of one microelectronic layer and then the substrate;

chemical mechanical polish planarizing the minimum of one microelectronic layer, while employing a chemical mechanical polish planarizing method, to form from the minimum of one microelectronic layer a minimum of one chemical mechanical polish planarized microelectronic layer; and determining a chemical mechanical polish planarizing endpoint within the chemical mechanical polish planarizing method with respect to the minimum of one chemical mechanical polish planarized microelectronic layer as an inflection point within a derivative of a reflected radiation intensity of a minimum of one reflected portion of the incident radiation beam reflected from the minimum of one microelectronic layer as the minimum to one microelectronic layer is chemical mechanical polish planarized to form the minimum of one chemical mechanical polish planarized microelectronic layer.

9. The method of claim 8 wherein the microelectronic layer is formed from a microelectronic material selected from the group consisting of microelectronic conductor materials, microelectronic semiconductor materials and microelectronic dielectric materials.

10. The method of claim 8 wherein the radiation beam is selected from the group consisting of optical radiation beams and acoustic radiation beams.

11. The method of claim 8 wherein the radiation beam impinges directly upon a surface of the minimum of one microelectronic layer.

12. The method of claim 8 wherein the radiation beam is incident substantially orthogonally to the substrate.

13. The method of claim 8 wherein the radiation beam is incident substantially non-orthogonally to the substrate.

* * * * *